United States Patent [19]

Jackson

[11] 4,272,942

[45] Jun. 16, 1981

[54] METHOD AND APPARATUS FOR CUSTOM CLOSING OR MODIFYING BUILDING OPENINGS

[76] Inventor: Edward L. Jackson, 215 Terrace Dr., Pauls Valley, Okla. 73075

[21] Appl. No.: 786,079

[22] Filed: Apr. 11, 1977

[51] Int. Cl.[3] ..... E06B 3/26

[52] U.S. Cl. ..... 52/741; 52/202; 52/747; 52/DIG. 4

[58] Field of Search ..... 52/202, 203, DIG. 4, 52/747, 741; 49/478, 62

[56] References Cited

U.S. PATENT DOCUMENTS

| | | | |
|---|---|---|---|
| 2,219,699 | 10/1940 | Owen | 52/202 |
| 3,004,309 | 10/1961 | Korodi | 49/478 |
| 3,102,314 | 9/1963 | Alderfer | 52/DIG. 4 |
| 3,124,501 | 3/1964 | Wise | 52/DIG. 4 |
| 3,556,374 | 7/1969 | Baermann | 52/DIG. 4 |
| 3,852,935 | 12/1974 | Jones | 52/DIG. 4 |

FOREIGN PATENT DOCUMENTS

| | | | |
|---|---|---|---|
| 1043272 | 9/1966 | United Kingdom | 52/DIG. 4 |

*Primary Examiner*—Alfred C. Perham
*Attorney, Agent, or Firm*—William R. Laney

[57] ABSTRACT

A method of sealing building openings, such as windows or the like, which comprises initially bonding a strip of ferro-magnetic or magnetic material to the structure which defines the opening in a course around the periphery of the opening. A strip of material which is magnetically attracted to the first-mentioned strip is then bonded to a closure panel in a course position to register with said first-mentioned course. Finally, the closure panel is positioned across the opening with the two strips of material superimposed, in registry and in contact to magnetically retain the closure panel in a pre-selected position in relation to the opening.

The apparatus used in carrying out the invention comprises at least two elongated strips of magnetic material having a strip of bonding material on one side thereof, at least two additional strips of material magnetically attractable to the first strips, a panel and adhesive bonding the additional strips to the panel at spaced locations on the panel.

3 Claims, 4 Drawing Figures

METHOD AND APPARATUS FOR CUSTOM CLOSING OR MODIFYING BUILDING OPENINGS

BACKGROUND OF THE INVENTION

1. Field of the Invention

This invention relates to a method for quickly and easily closing or modifying an opening in a building, such as a window, by magnetic fixation of a selected closure panel, or of a panel selected for properties which modify an existing closure panel already in place.

2. Brief Description of the Prior Art

Magnetic signs which may be quickly positioned on the sides of automobiles or other metallic structures are well known. The force of attraction of the magnets carried in one facing surface of the sign enables the signs to become firmly attached to a surface made of a ferro-magnetic material and the signs can be manually emplaced at a selected position without difficulty.

With the growing intensity and criticality of the lessening of energy supplies available for heating and cooling living spaces and the interiors of various structures intended for habitation, rapidly increasing attention is being devoted to the problem of preventing thermal transfer through the defining boundaries of such structures, such as the walls and ceiling thereof. Insulation in various forms and of various types has been proposed, and thermal barriers effected by the provision of dead air space between the external environment and the interior of the structure have been a widely used expedient for reducing thermal transfer across the boundary of structures. Thus, in many types of thermal pane windows now available, two panels or panes of glass are provided in parallel relation and enclose between them an air space which, by reason of its poor thermal conductivity, affords good insulating properties while retaining the visual transparency of the window closure thus provided. In other instances, heavy storm windows are utilized and are placed in position during the cold season of the year and removed in warmer weather.

In the case of either the thermal pane construction or the use of storm windows, certain problems and disadvantages are posed in each instance. In the case of the thermal pane windows which include the double glass panels with the dead air space between the panels, elaborate seals must be provided at the edges of the panels in order to prevent the loss of air from between the panels, and the infiltration of cold external air into the interior space. At times droplets of moisture condense on one of the inner faces of the glass panels, obscuring vision and providing an unsightly appearance to the closure constituted by the thermal pane. Further, such structures are often relatively expensive due to the construction of the framing and seals which are utilized. In the case of storm windows, as these structures are normally used, a storage space for storing and locating the storm windows when they are not in use is required. Moreover, installation is frequently time-consuming and, over periods of extended usage, warping or distortion of the framing of the windows can prevent a tight fit and thus develop a loss in insulation efficiency.

In the case of both the thermal pane closures and storm windows, the type of closure which is effected by each is substantially invariable. This is to say that once a particular type of glass is provided in either structure, it cannot be varied as to light transmissibility of aesthetic properties except by the complete replacement of the entire structure at a very considerable cost. Moreover, it is seldom easy or convenient to quickly and easily replace the transparent glass panes which are utilized in these systems with an opaque panel system to provide semi-permanent privacy or, if it should be desired, one-way viewing. Further, the sound transmission properties of the panels used remains invariant except by complete replacement of the entire system.

GENERAL DESCRIPTION OF THE PRESENT INVENTION

The present invention provides an improved method, and relatively simple inexpensive structure for carrying out, or closing or modifying openings in structures such as buildings. The method offers the great advantage and desirable feature of excellent economy, and in this respect affords opportunity to relatively low income or semi-poverty afflicted persons to easily and inexpensively provide better thermal insulation at the openings in dwellings which they occupy, as well as to be more selective in the type of aesthetics which may characterize the closures of those openings.

Broadly described, the method for sealing or modifying building openings, as constituted by the present invention, comprises initially bonding a strip of magnetic material to the structure which defines the opening in a course around the periphery of the opening. The term "magnetic material" is here used in the generic sense of including both magnetized materials which function as magnets, and ferro-magnetic materials which are attracted to magnetized material. Also, the term "opening" as here used is intended to refer to a space which has definition in terms of a peripherally surrounding structure and, while in most instances the term refers to the opening formed through the walls or other structural members conventionally employed in a building, it also may refer to some portion of that total opening, such as an area present within the opening and disposed on a glass panel or the like currently in position for the purpose of closing the opening.

After the placement of the magnetic strip by bonding in a course around the periphery of the opening in the manner described, one or more strips of additional material which are magnetically attracted to the first-mentioned strip are bonded to a substantially mono-planar panel in a course or courses on such panel such that the second strip of material will register with the first-mentioned course as occupied by the first material. Finally, the closure panel is positioned across or over the opening with the two strips of material superimposed in registry and in contact with each other to magnetically retain the panel in a preselected position in relation to the opening.

The apparatus used in carrying out the method of the invention comprises at least two elongated strips of magnetic material having a strip of bonding material on one side thereof, at least two additional strips of material magnetically attractable to the first strips, a panel and adhesive bonding the additional strips to the panel at spaced locations on the panel.

An important object of the present invention is to provide a different and relatively inexpensive method for attaching glazing or covering panels for windows, skylights, lighting units or openings in buildings to provide insulation, privacy, sound barrier effect or light diffusion.

A further object of the present invention is to provide economical means for conserving energy by reducing the energy losses across a closure for openings in buildings.

An additional object of the invention is to provide a transparent panel member having magnetically actuable securement means attached thereto facilitating the rapid and simple placement of the panels over an opening in a building to provide ready installation and removal, according to seasonal requirements.

An additional object of the present invention is to provide a closure panel for closing openings through buildings, which closure panel permits easy access to the interior space between the closure panel and another permanently emplaced panel so that collected moisture or condensation which may develop between the panels can be quickly and easily removed by removal of the closure panel of the invention.

An additional object of the invention is to provide a method for installing multiple closure panels with spaced surfaces defining air gaps therebetween in an economic and expeditious manner over openings in building structures.

A further object of the invention is to provide an economical method for installing selected and custom-constructed panels over the openings in buildings so as to provide a choice of thermal and sound transmission properties in the panel, and to provide multiple options in the aesthetic effects which can be realized from the installed panel.

A further and additional object of the invention is to provide a multiple paneling system in which superimposed panels are adapted by the character of the system for quick superimposition over, and closure of, openings through buildings or the like, with highly effective air and moisture seals being established between the multiple superimposed panels and the building upon which they are located.

Additional objects and advantages will become apparent as the following detailed description of preferred embodiments of the invention is read in conjunction with the accompanying drawing which illustrates certain preferred embodiments.

GENERAL DESCRIPTION OF THE DRAWINGS

DETAILED DESCRIPTION OF PREFERRED EMBODIMENTS OF THE INVENTION

Figure 1:
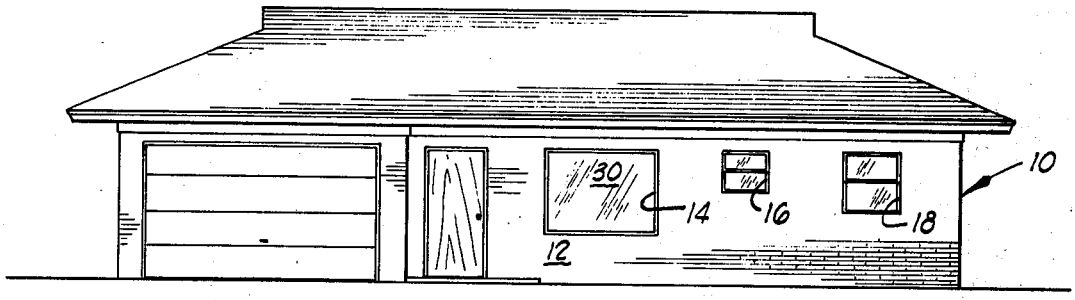
FIG. 1 is a front elevation view of a residential structure having window openings in the wall thereof, and having the present invention installed in the window openings and effecting closure thereof.

Referring initially to FIG. 1 of the drawings, a home or residence 10 is there illustrated, and includes, in a wall 12 thereof, a plurality of window openings 14, 16 and 18. The window openings 14, 16 and 18 are closed by closure structures constructed in accordance with the present invention as hereinafter explained.

Figure 2:
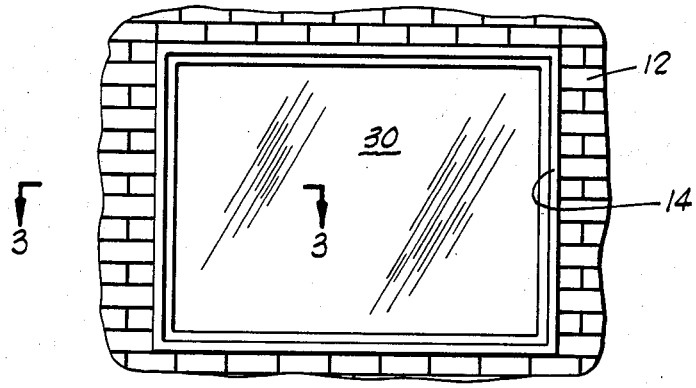
FIG. 2 is an enlarged view in elevation of one of the window openings shown in FIG. 1.

FIG. 2 illustrates, in enlarged form, the window opening 14 which, for purposes of discussion, may be considered as a large picture window type opening. Considering FIGS. 2 and 3 together, it is shown that the closure structure used for closing the opening 14 with a transparent barrier material includes an inner pane or panel 20 of glass which is fitted within a wooden frame 22, and abuts around its outer edges against a shoulder 24 formed on the frame 22 and facing inwardly toward the opening 14. The pane 20 is retained in this position by a suitable glazing material 23 which is applied in a conventional manner.

Figure 3:
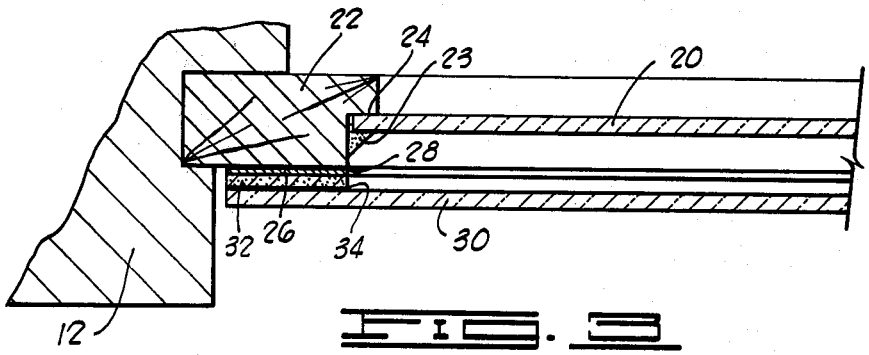
FIG. 3 is a sectional view taken along line 3—3 of FIG. 2.

A strip of magnetic material 26 is secured around the inner periphery of the outwardly facing surface of the door frame 22, and in the embodiment of the invention illustrated in FIG. 3 is a strip of ferrous metal foil 26 which is secured to the face of the frame 22 by a suitable adhesive 28. Although adhesive securement of the foil ferro-magnetic strip 26 is preferred, the strip can be nailed or stapled in position. Adhesive securement is preferred since it provides a better weather and thermal seal between the ferro-magnetic strip 26 and the wood surface of the panel 22. The ferro-magnetic strip 26 is extended completely around the perimeter of the window opening 14, and thus surrounds the pane 20.

A second panel or pane 30 of transparent material is provided, and is of an area sufficient to extend across or overlap the outwardly facing surfaces of the frame 22. Around its outer periphery, and on that surface of the pane 30 which faces the frame 22, the pane carries a strip of magnetic material. In the illustrated embodiment of the invention, this strip is a magnetic strip 32 in which are located or embedded, a plurality of very small bar magnets which are preferably oriented to dispose like poles of each of the bar magnets toward the frame 22. The strip of magnetic material 32 is secured to the surface of the pane or panel 30 which faces the pane 20 by means of a suitable adhesive 34. It will be apparent that the course followed by the strip 26 of ferro-magnetic foil around the frame 22 corresponds to the course followed by the magnetic strip 32 around the perimeter of the pane 30 so that the two strips will register and be superimposed at the time when the panel 30 is placed in the position shown in FIG. 3. It should further be pointed out that with some types of panels other than glass, other means for bonding the strip 32 of magnetic material to the surface of the panel can be used in lieu of adhesive.

In the practice of the method of the invention, the ferro-magnetic foil strip 26 is initially placed in position by the use of the adhesive 28 or by a similar fastening instrumentality. A magnetic strip similar to the strip 26 can also effectively be utilized at this location, as will be hereinafter explained. The course in which the strip 26 is placed around the opening 14 by attachment to the frame 22 will be determined in part by the available surface area, and in part by the size or type of pane 30 which is to be located across the opening 14 in the general manner shown in FIG. 3. The surface upon which the foil strip 26 is placed will preferably be spaced a significant distance from the pane 20 so as to provide an air void or gap between the pane 20 and the pane 30 when the latter is ultimately installed.

After placement of the strip of ferro-magnetic foil material 26 on the frame 22, the magnetic strip 32, in one or more parts (in the illustrated usage of the invention, four strips are employed in the form of a rectangle), is secured to a monoplanar facing surface of the glass pane 30, preferably using adhesive. Placement of the strip 32 is at a location, and along a course, which will coincide with the course of the first ferro-magnetic strip 26, so that the two strips will register and precisely contact each other when they are superimposed in abutting relation in the manner shown in FIG. 3. After placement of the magnetic strip 32 around the perimeter of the pane 30 in the manner described, the pane is lifted and is placed in its illustrated position over the opening 14 with the magnetic strip 32 flatly contacting and bearing against the ferro-magnetic foil strip 26. The magnetic attraction developed between the magnetic strip 32 and the ferro-magnetic foil strip 26 assures that the pane 30 will be retained precisely in the position in which these strips are contacted in superimposed relation as shown in FIG. 3, and thus that the pane 30 extends parallel to the pane 20 and completely across the window opening 14.

It should here be pointed out that a very important aspect of the present invention is the capability of enhancing the thermal barrier afforded by conventional windows placed in window openings. To this end, it is important that the contacting monoplanar surfaces of the strips 32 and 26 be relatively smooth so that a maximum surface area of contact obtains between the two strips. It is also important that the fastening means employed for securing the ferro-magnetic strip 26 to the frame 22, and the magnetic strip 32 to the pane 30, be of a character such that no air penetration or infiltration between the respective strips and the members upon which they are mounted can occur. A layer of suitable adhesive material corresponding in transverse width to the width of the respective strips will generally accomplish this result.

When the pane or panel 30 is lifted and placed in position across the opening 14 in the manner illustrated and described, a double paned window is provided which defines between the spaced parallel panes, a dead air gap or space in which air is sealed and prevented from loss from this space by the effective closure provided at the contacting surfaces of the strips 26 and 32. Thus, the thermal loss through the closure afforded by the glass pane 20 when used alone, and resulting from the periodic large temperature differential between the inside of the house and the outside atmosphere, is greatly reduced. The dead air space created between the panes 20 and 30 acts as a very effective thermal barrier, and the infiltration of moist external air into this space to create significant condensation and moisture accumulation problems is obviated.

A very important aspect of the invention as thus constituted is the ability it enables to very quickly and easily create a double-paned window closure having a dead air space between panes, without the expense of hiring expert installation crews, or the necessity of replacing conventional one-pane windows with an expensive thermal pane structure manufactured at substantial cost as a result of the sophisticated seals provided around and between the two panes thus provided. Moreover, the practice of the method is such that a layman without woodworking or caulking experience can successfully accomplish the assembling of the structures required to provide the highly effective closure resulting from the practice of the method. The materials utilized are very inexpensive, and both the ferro-magnetic foil strip material 26 and the magnetic strip 32 are commercially available.

Another important aspect of the invention is the ability, through the practice of the method of the invention, to provide different effects, both practical and aesthetic, in constructing an opening closure of the sort described. Thus, the glass panel 30 can be custom selected to provide certain solar reflective characteristics or properties which reduce radiant heat transfer through the closure assembly. Moreover, the panel 30 may be selected to provide a particular aesthetic effect, such as a tinting or filtering function which reduces glare to the inside of the house 10 and perhaps provides, for example, a soft tinted color effect to the viewer inside the home. It is also possible through the use of the invention to install outer panels at the location of the panel 30 which are characterized in permitting one-way transparency to be realized. Such panels, of course, permit the occupants of the home to have full view of the landscape outside the house, but prevent persons on the outside of the house from seeing through the window closure to the inside thereof.

Figure 4:
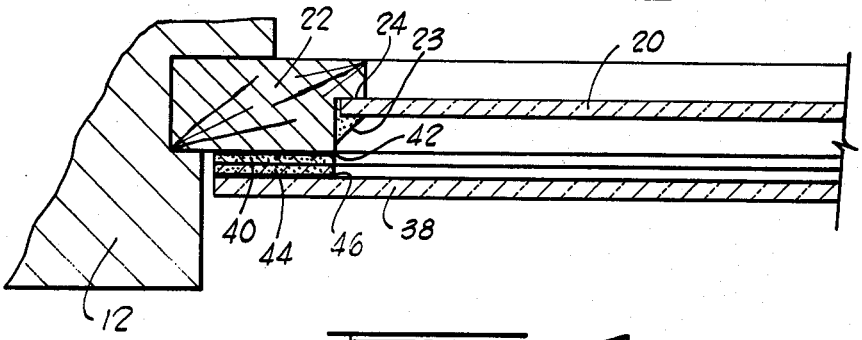
FIG. 4 is a sectional view similar to FIG. 3 but illustrating an alternate embodiment of the invention.

An alternate embodiment of the invention is depicted in FIG. 4 of the drawings. In this embodiment of the invention, the wall 12, internal pane or panel 20 and frame 22 are substantially identical to these structures as illustrated in FIG. 3. The method of attaching an outer pane or panel 38 across the window opening 14 is, however, different from that illustrated in FIG. 3. In the FIG. 4 embodiment, a magnetic strip 40 is secured to the outwardly facing surface of the frame 22 by means of an adhesive 42. As previously explained, the magnetic strip 40 contains very small bar magnets embedded therein, which magnets are, in this instance, oriented with alternate poles thereof facing toward that surface of the strip 40 which is opposite its surface bonded to the frame 22. The embedded magnets are spaced so that their fields at the unlike poles presented to the outwardly facing surface of the strip are not significantly interfering with each other.

A similar magnetic strip 44 is adhered by a suitable adhesive 46 to the surface of the pane 38 around the outer periphery thereof in a position to register with the strip 40. The strip 44 also contains small bar magnets embedded therein. The bar magnets carried in the strip 44 are oriented in relation to the magnets embedded in the srip 40 so that when the strips 40 and 44 are superimposed in registering alignment, the poles of like polarity of the magnets in the strip 44 are immediately opposite poles having an opposite polarity carried by magnets positioned in the magnetic strip 40. This results in an attactive force being developed between the several magnets carried in the strips 40 and 44, and a very tenacious bond or fastening action occurring when the panel 38 is placed over the opening 14 in the position illustrated in FIG. 4.

An important aspect of the embodiment of the invention illustrated in FIG. 4 is the greater adherence or tenacity of the magnetic connection between the panel 38 and the frame 22 of the opening 14. The attraction between unlike poles of the magnets carried in the two strips assures that the panel 38 will remain very firmly emplaced, and that the seal effected between the strips 40 and 44 will, in general, be better than that which is realizable when the ferro-magnetic foil strip 26 and the magnetic strip 32 are employed in the manner shown in FIG. 3.

It should further be pointed out that the nature of the orientation of the bar magnets in each of the strips 40 and 44 facilitates ease of removal of the panel 38 from its superimposed, fastened-in-place position. Thus, by bearing against the pane 38 with a slight pressure and canting or twisting this pane very slightly, the like poles of magnets embedded in the strips 40 and 44 can be brought opposite each other with the result that there is a repulsive force developed which quickly and automatically releases the strip 44 from the strip 40, and enables the pane 38 to be very simply and easily removed from its illustrated closing position. It may be desirable in some instances to provide an indentation in the panel 38 or a slight projection in the form of a handle or the like to facilitate the slight canting or twisting movement on the pane 38 necessary to misalign the unlike poles of the magnets carried in the strips 40 and 44, and bring the like poles into alignment to gain the desired repulsive action.

The great versatility of usages which are characteristic of the present invention are unique, and make its construction and use highly attractive and desirable. Thus, it can be used for attaching glazing or covering panels to existing windows or skylights, and it can be used, as previously described, to greatly improve the insulating character of existing windows, and to reduce thermal transfer across the closures provided in openings to buildings. It can enhance the privacy of the dwelling or building in which the invention is used, either by reducing the visibility through the closure to the inside of the structure, or by reducing the transfer of sound across the closure structure, or both of these results can be realized quite easily. The extent to which the closure panels diffuse sunlight can also be easily controlled by appropriate selection of the panel, since substantially any type of monoplanar panel or pane can be used in the process of the process invention.

Perhaps the most important aspect of the present invention is the economy with which the invention can be practiced and the materials needed in carrying out the invention manufactured and marketed. The magnetic and ferro-magnetic strips used are relatively inexpensive, can be installed by the layman using readily available adhesives of low cost, and the panels, when prepared for placement, can be easily located in the most effective position.

The ease of installation of panels in accordance with the invention is matched by the ease with which they may be removed. Thus, for example, the invention provides a great advantage in providing very quick and safe access through windows to fire escapes. In this regard, it should be noted that while the invention, for purposes of illustration and discussion, has been described as including an external pane or panel 38 placed in position and retained there by means of magnetic strips, the principles of the invention are equally applicable to the installation of internal panels or panes, or even direct superimposition of one pane or panel on the other by securement of both strips of magnetic material to the dual panes which are utilized.

The ease by which the panels may be separated also facilitates the quick removal of any condensation or moisture which may develop on the inner and facing surfaces of either or both panels. Moreover, the magnetic strips used can be beneficially covered by a thin coating or layer of rubber without affecting the magnetic force which provides the fastening or holding function. Where such rubber coatings are provided on one or both of the facing strips, this, coupled with the selection of an appropriate adhesive for securing the panels to their supporting surfaces, enables the expansion or contraction of the panels with changing thermal conditions to be easily accommodated without damage or deleterious effect.

Panels with a magnetic strip containing the embedded magnets adhered thereto in a course around the periphery of the panel can be used directly on steel-framed windows or openings without the requirement to provide the strip of magnetic or ferro-magnetic material around the opening, and adhered to the frame. Where the surface to which one of the strips is to be attached is rough or irregular (such as clapboard siding), it may be desirable to initially bond or fasten the strip thereto by any suitable means, such as tacking, nailing, stapling or the like, and to then caulk the spaces or openings which remain between the strip and the frame or surface to which it is thus attached.

From the foregoing description of the invention, it will be apparent that the present invention provides an important contribution to the ongoing efforts to improve the efficiency with which energy may be consumed in buildings in which the interior is maintained at a substantially different temperature than the environment surrounding the building during a major portion of the year. Moreover, the improvement in such thermal efficiency is achieved at a relatively low cost, making the advantages of the invention available to those of modest economic means. The ways in which the principles of the invention can be used are many, and the advantages afforded in aesthetics, sound transmission, ease of installation and economics are marked.

Although certain preferred embodiments of the invention have been herein described, it will be understood that various changes and innovations of the described embodiments can be effected without departure from such basic principles, and such changes and innovations are deemed to be circumscribed by the spirit and scope of the invention, except as the same may be limited by the appended claims or reasonable equivalents thereof.

What is claimed is:

1. A method for sealing an opening in a building comprising:

fastening to, and in contact with, a structure which defines the opening, a plurality of first magnetic strips containing a plurality of magnets, with adjacent magnets so positioned as to have alternate poles thereof facing towards a surface of each of said first strips opposite a surface of each of said first strips which is in contact with the structure which defines the opening, said first magnetic strips being positioned in a course extending around the entire outer periphery of the opening;

closing said opening by positioning a first glass pane thereacross;

positioning, upon a second glass pane, a second magnetic strip containing a plurality of magnets so that the magnets in said second strip are positioned to align poles thereof with at least some of the unlike poles of the magnets in said first magnetic strips when said second strip is superimposed over at least one of said first strips and in registry therewith;

fastening, to said second glass pane, said second magnetic strip; and placing said second glass pane over the opening and in a plane spaced from the plane occupied by said first glass pane to define air space between said glass panes so that said second strip is superimposed over at least one of said first strips and in registry therewith, and so that said second glass pane may be removed from engagement with the structure which defines the opening by twisting the second glass pane about an angle within the plane of the second glass pane whereby at least one first magnet of said plurality of said magnets in said second magnetic strip will be moved from a position adjacent an unlike pole of at least one magnet in said plurality of magnets in at least one of said first magnetic strips to a position adjacent a like pole of a third magnet of said plurality of magnets in one of said first magnetic strips, whereby a repulsive force will be generated between said first and third magnets, thereby urging the closure panel out of engagement with the structure which defines said opening.

2. The method defined in claim 1 wherein said structure is a window frame having at least one glass pane mounted therein in said opening.

3. An improved method for the removal of a closure panel, of the type including a plurality of magnetic strips containing a plurality of magnets engaging the periphery of said closure panel, from a building opening, of the type having a plurality of magnetic strips containing a plurality of magnets engaging the outer periphery of said building opening, with the magnets of said closure panel being positioned with adjacent magnets positioned to have poles thereof oriented approximately 180° one from the other and with the magnets of said closure panel being positioned to align poles thereof with unlike poles of the magnets of said building opening, comprising:

twisting the closure panel about an angle within the plane of the closure panel;

positioning like poles of the magnets in said strips of said closure panel and said building opening opposite each other so as to create repulsive forces therebetween; and moving said strips of said closure panel out of contact with said strips of said building opening.

* * * * *